US010406838B2

(12) United States Patent
Ohashi et al.

(10) Patent No.: US 10,406,838 B2
(45) Date of Patent: Sep. 10, 2019

(54) INKJET PRINTING APPARATUS

(71) Applicant: CANON KABUSHIKI KAISHA, Tokyo (JP)

(72) Inventors: Tetsuyo Ohashi, Yokohama (JP); Yasuyuki Takanaka, Yokohama (JP); Tetsuya Ishikawa, Yokohama (JP); Seiji Ogasawara, Machida (JP); Noriko Sato, Kawasaki (JP); Akira Kida, Yokohama (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/891,807

(22) Filed: Feb. 8, 2018

(65) Prior Publication Data

US 2018/0236797 A1 Aug. 23, 2018

(30) Foreign Application Priority Data

Feb. 17, 2017 (JP) ..... 2017-028022

(51) Int. Cl.
*B41J 2/165* (2006.01)
*B41J 25/34* (2006.01)
(Continued)

(52) U.S. Cl.
CPC ..... *B41J 25/316* (2013.01); *B41J 2/1433* (2013.01); *B41J 2/16585* (2013.01); *B41J 2/175* (2013.01); *B41J 25/304* (2013.01)

(58) Field of Classification Search
CPC .. B41J 2/1433; B41J 2/16535; B41J 2/16585; B41J 2/16588; B41J 2/175; B41J 25/001; B41J 25/34; B41J 25/304; B41J 25/316
See application file for complete search history.

(56) References Cited

U.S. PATENT DOCUMENTS 5,917,514 A * 6/1999 Higuma ..... B41J 2/16505 206/813
6,068,374 A 5/2000 Kurata et al.
(Continued)

FOREIGN PATENT DOCUMENTS

EP 2 572 884 A1 3/2013
JP 05-124209 A 5/1993
(Continued)

OTHER PUBLICATIONS

Extended European Search Report dated Jul. 13, 2018, in European Patent Application No. 18000108.3.
(Continued)

*Primary Examiner* — Anh T Vo
(74) *Attorney, Agent, or Firm* — Venable LLP

(57) ABSTRACT

An inkjet printing apparatus includes a print head configured to perform a print operation, the print head having an ejection opening surface on which a plurality of ejection openings for ejecting ink are arrayed along a width direction, and a moving unit configured to move the print head between a printing position, in which the print operation is performed, and a standby position, in which the print operation is not performed. The moving unit moves the print head between the printing position and the standby position by simultaneously performing rotational movement, in which the print head is rotated around a rotation axis that is parallel to the width direction, and linear movement in the gravitational direction, of the print head.

20 Claims, 11 Drawing Sheets

(51) Int. Cl.

| | |
|---|---|
| ***B41J 25/316*** | (2006.01) |
| ***B41J 2/175*** | (2006.01) |
| ***B41J 2/14*** | (2006.01) |
| ***B41J 25/304*** | (2006.01) |

(56) References Cited

U.S. PATENT DOCUMENTS

| | | | | |
|---|---|---|---|---|
| 7,922,312 | B2 * | 4/2011 | Haines | B41J 2/17513 347/91 |
| 8,702,215 | B2 | 4/2014 | Kawase et al. | |
| 8,876,280 | B2 | 11/2014 | Ishikawa et al. | |
| 9,186,900 | B2 | 11/2015 | Ishida et al. | |
| 9,315,041 | B2 * | 4/2016 | Moriguchi | B41J 2/175 |
| 2007/0120886 | A1 | 5/2007 | Turner et al. | |
| 2009/0073213 | A1 | 3/2009 | Iwata | |
| 2013/0076831 | A1 * | 3/2013 | Ishida | B41J 2/16588 347/37 |
| 2013/0106963 | A1 * | 5/2013 | Kawase | B41J 2/17509 347/85 |
| 2018/0236791 | A1 | 8/2018 | Ohashi et al. | |

FOREIGN PATENT DOCUMENTS

| | | | |
|---|---|---|---|
| JP | 2000-301710 | A | 10/2000 |
| JP | 2008-137176 | A | 6/2008 |
| JP | 2009-072925 | A | 4/2009 |
| JP | 2011-218761 | A | 11/2011 |
| JP | 2013-067080 | A | 4/2013 |
| JP | 2013-095060 | A | 5/2013 |

OTHER PUBLICATIONS

Office Action (with Translation) dated Mar. 15, 2019, issued in Japanese Patent Application No. 2018-023981.

U.S. Appl. No. 15/880,635, Tetsuyo Ohashi Yasuyuki Takanaka Tetsuya Ishikawa Seiji Ogasawara Noriko Sato Akira Kida Noboru Shimoyama, filed Jan. 26, 2018.

* cited by examiner

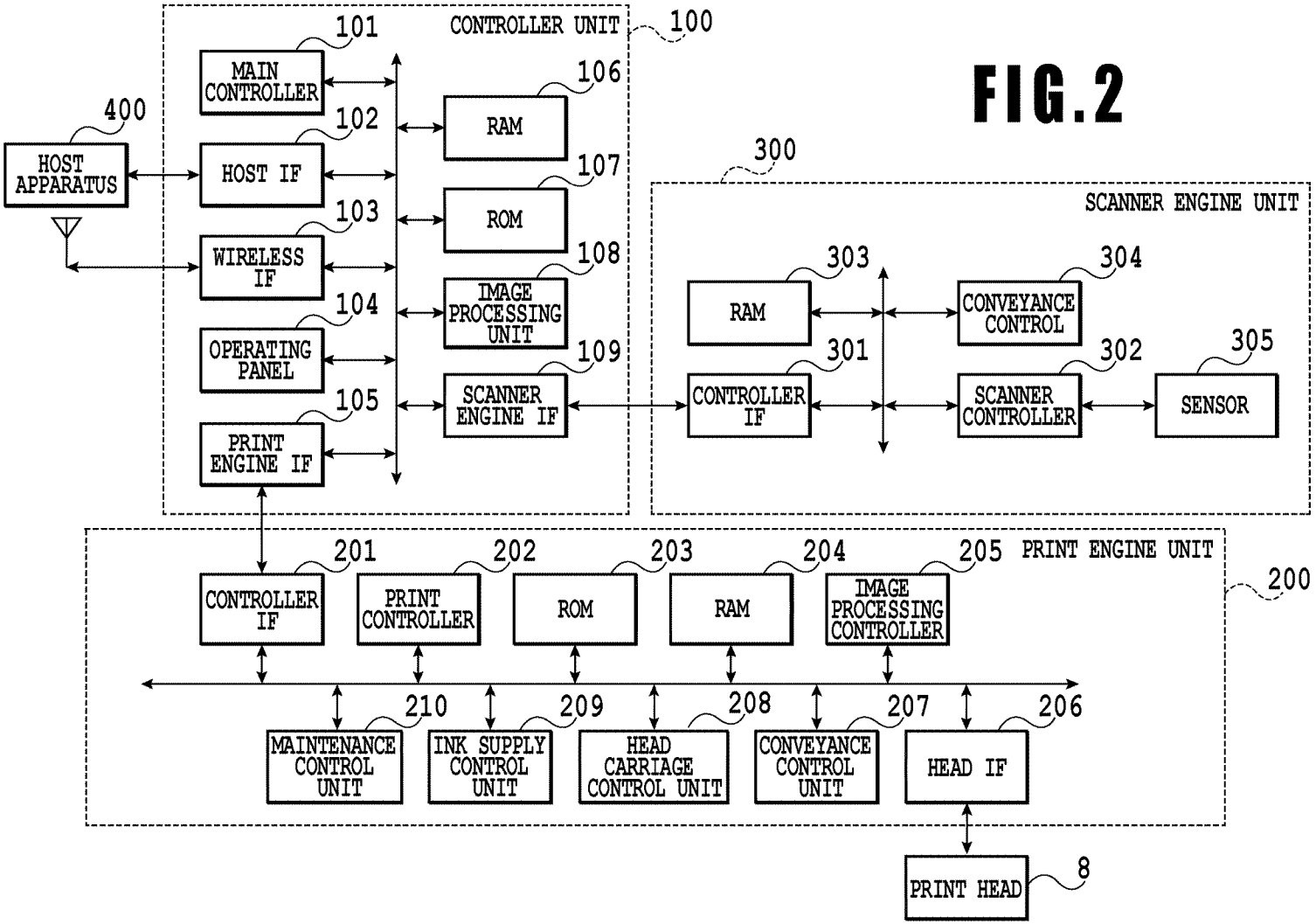
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSING UNIT
108
SCANNER ENGINE IF
109
HOST APPARATUS
400
SCANNER ENGINE UNIT
300
RAM
303
CONTROLLER IF
301
CONVEYANCE CONTROL
304
SCANNER CONTROLLER
302
SENSOR
305
PRINT ENGINE UNIT
200
CONTROLLER IF
201
PRINT CONTROLLER
202
ROM
203
RAM
204
IMAGE PROCESSING CONTROLLER
205
MAINTENANCE CONTROL UNIT
210
INK SUPPLY CONTROL UNIT
209
HEAD CARRIAGE CONTROL UNIT
208
CONVEYANCE CONTROL UNIT
207
HEAD IF
206
PRINT HEAD
8

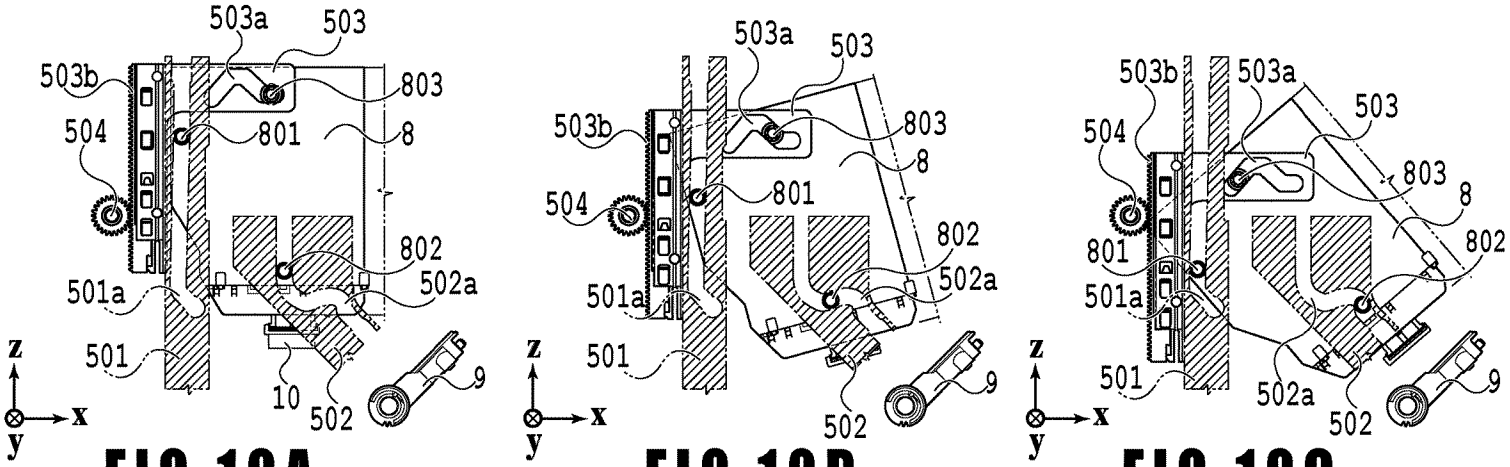
FIG.10A
FIG.10B
FIG.10C
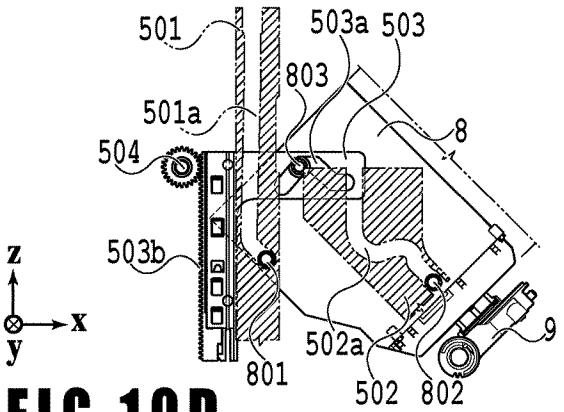
FIG.10D
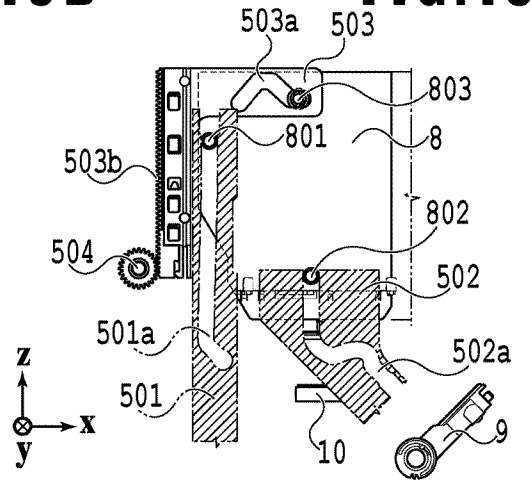
FIG.10E

INKJET PRINTING APPARATUS

BACKGROUND OF THE INVENTION

Field of the Invention

The present invention relates to an inkjet printing apparatus comprising a print head that ejects ink to print an image.

Description of the Related Art

Japanese Patent Laid-Open No. 2009-072925 discloses a printing apparatus using an inkjet head, wherein the orientation and position of a print head are changed so as to eject ink horizontally during print operation and eject ink vertically downward during maintenance operation. According to Japanese Patent Laid-Open No. 2009-072925, when moving the print head from a position for print operation to a position for maintenance operation, the print head is first moved linearly in a direction away from a print medium and then turned around a rotation axis.

However, according to Japanese Patent Laid-Open No. 2009-072925, a mechanism to move the print head linearly and a mechanism to turn the print head are individually provided and are sequentially activated. As a result, mechanisms and control regarding the movement of the print head become complicated and the movement takes a long time.

SUMMARY OF THE INVENTION

In consideration of the problem described above, the present invention aims to provide an inkjet printing apparatus capable of performing the movement of a print head accompanied by linear movement and rotational movement in a short time using a simpler configuration.

According to a first aspect of the present invention, there is provided an inkjet printing apparatus comprising a print head configured to perform print operation, the print head having an ejection opening surface on which a plurality of ejection openings for ejecting ink are arrayed, and a moving unit configured to move the print head between a printing position, in which the print operation is performed, and a standby position, in which the print operation is not performed, wherein the moving unit moves the print head between the printing position and the standby position by simultaneously performing rotational movement and vertical linear movement of the print head.

According to a second aspect of the present invention, there is provided an inkjet printing apparatus comprising a print head configured to perform print operation, the print head having an ejection opening surface on which a plurality of ejection openings for ejecting ink are arrayed, and a moving unit configured to move the print head between a printing position, in which the print operation is performed, and a standby position, in which the print operation is not performed, wherein the moving unit moves the print head between the printing position and the standby position by performing rotational movement and vertical linear movement of the print head by using a single driving source.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 10A to 10E are diagrams showing a mechanism to move the print head.

DESCRIPTION OF THE EMBODIMENTS

Figure 1:
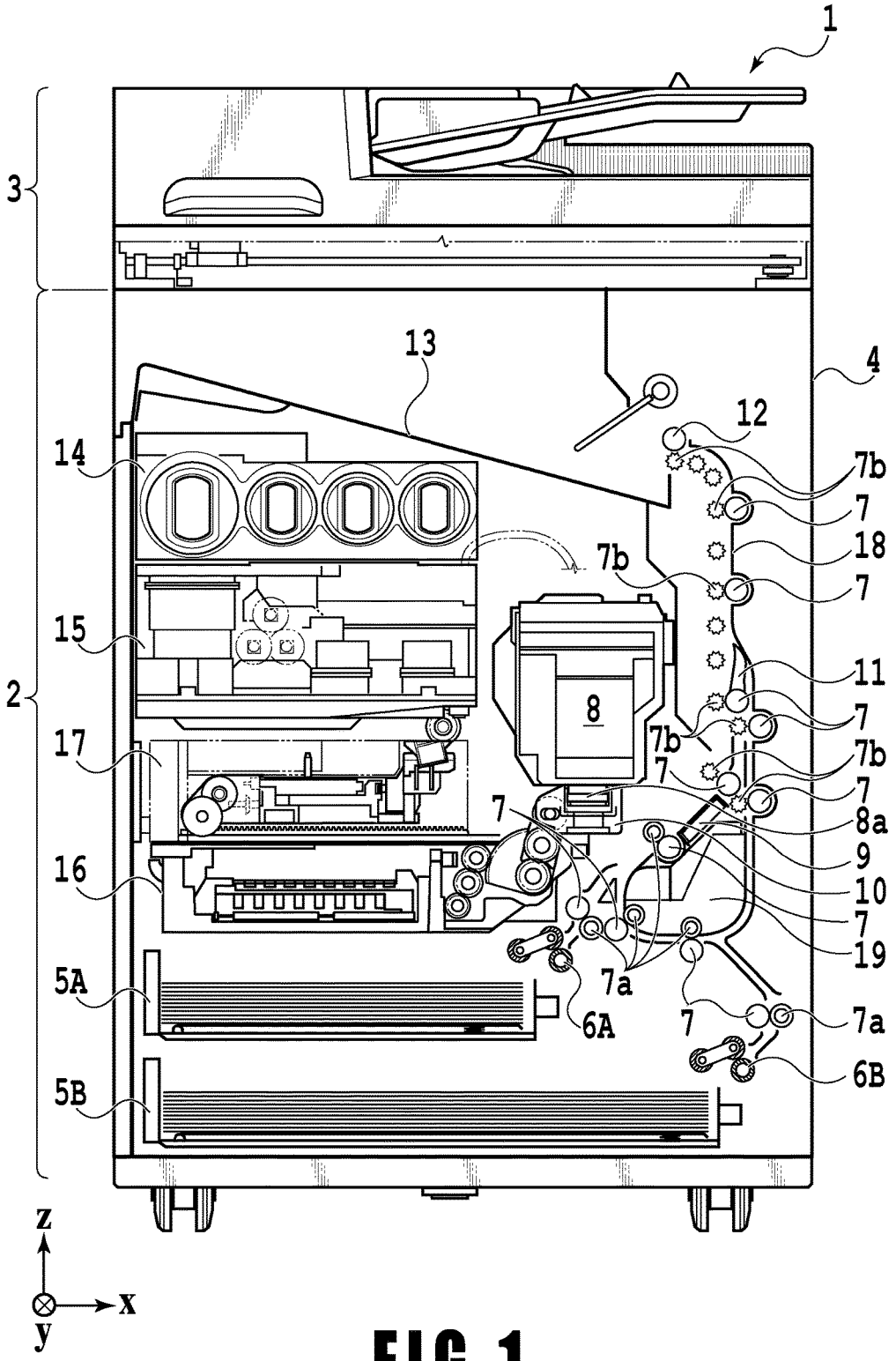
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately, or in synchronization, to perform various processes related to a print operation and a scan operation. The scanner unit 3 comprises an automatic document feeder (ADF) and a flatbed scanner (FBS), and is capable of scanning a document automatically fed by the ADF, as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state, in which neither the print operation nor the scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in a duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings, configured to eject ink based on print data, are arrayed in the y-direction in FIG. 1 so as to correspond to the width of a print medium S. When the print head 8 is in a standby position, an ejection opening surface 8*a* of the print head 8 is oriented vertically downward and capped with a cap unit 10, as shown in FIG. 1. In a print operation, the orientation of the print head 8 is changed by a print controller 202, described later, such that the ejection opening surface 8*a* faces a platen 9. The platen 9 includes a flat plate extending in the y-direction and supports, from the back side, a print medium S subjected to the print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform a maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited to such a system. For example, as a communication system for the wireless communication, Wi-Fi® (Wireless Fidelity) and Bluetooth® can be used. As a communication system for the wired communication, a USB (Universal Serial Bus), and the like, can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform the print operation based on the print data via a head I/F 206. At this time, the print controller 202 conveys a print medium S by driving the feeding units 6A and 6B, the conveying rollers 7, the discharging roller 12, and the flapper 11 shown in FIG. 1 via a conveyance control unit 207. The print head 8 performs the print operation in synchronization with the conveyance operation of the print medium S under instructions from the print controller 202, thereby performing printing.

A head carriage control unit 208 changes the orientation and position of the print head 8 in accordance with an operating state of the printing apparatus 1, such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and the wiping unit 17 in the maintenance unit 16 when performing the maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and to cause a sensor 305 to scan the document. The scanner controller 302 stores scanned image data in a RAM 303. The print controller 202 can convert the image data acquired as described above into print data to enable the print head 8 to perform the print operation based on the image data scanned by the scanner controller 302.

Figure 3:
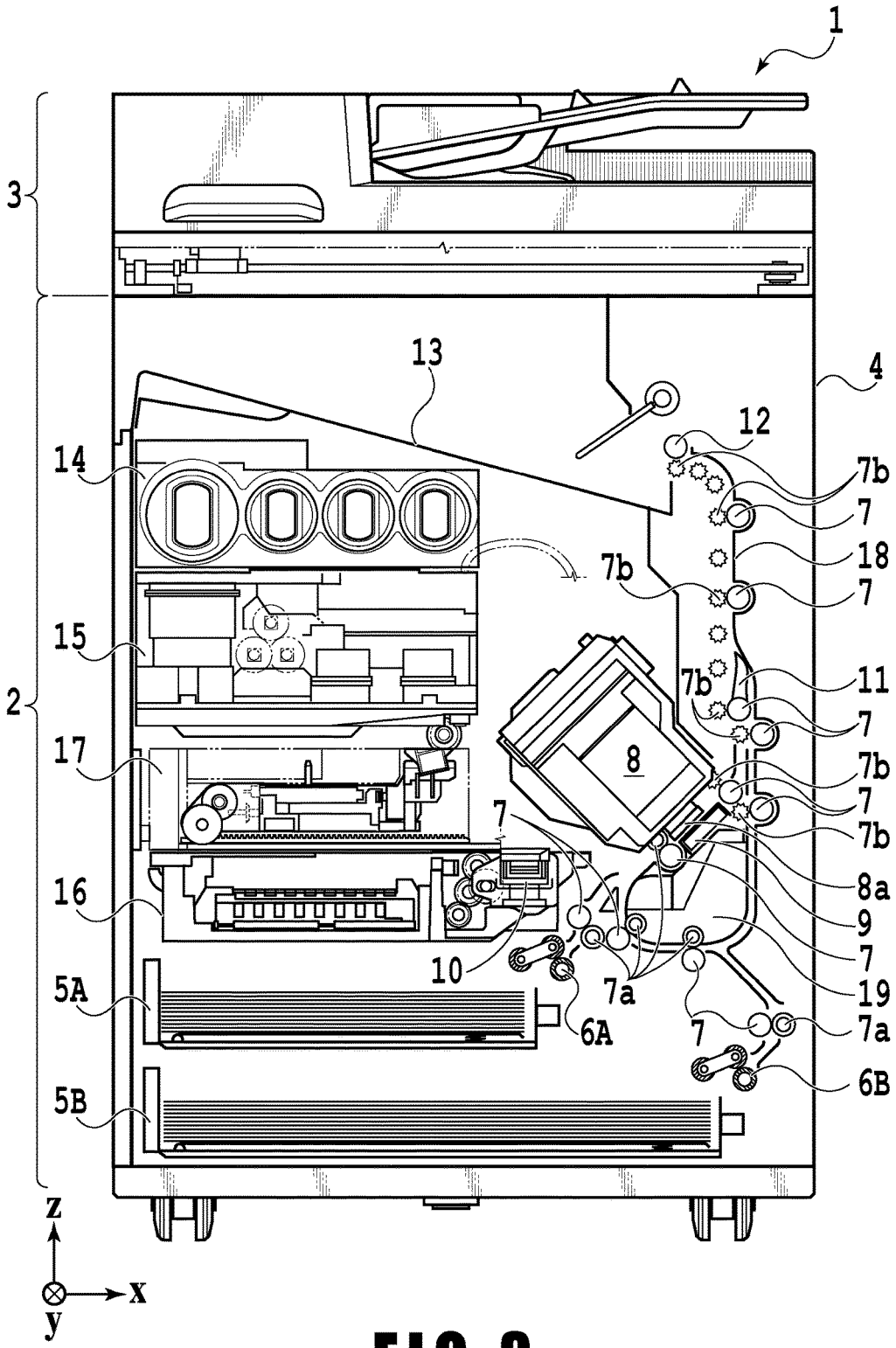
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 by 45° while adjusting the vertical height of the print head 8 such that the ejection opening surface 8*a* faces the platen 9. After the completion of the print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
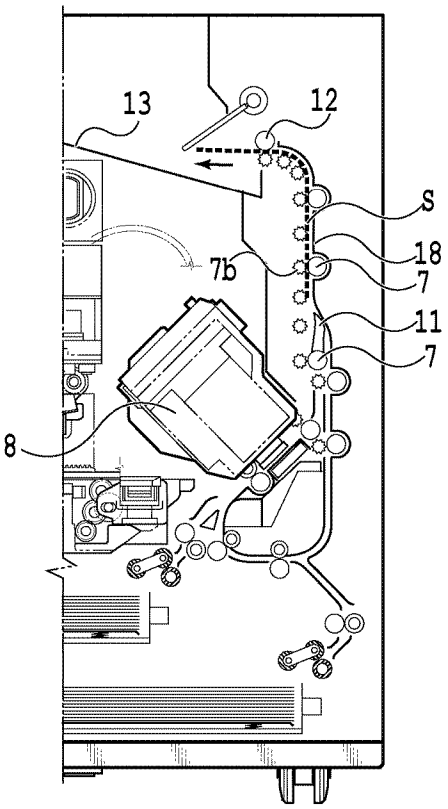
FIGS. 4A to 4C are conveying path diagrams of a print medium fed from a first cassette.
Figure 4B:
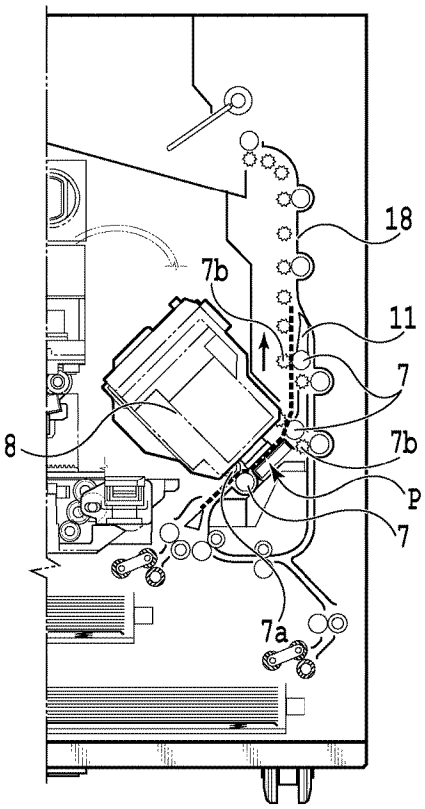
Figure 4A:
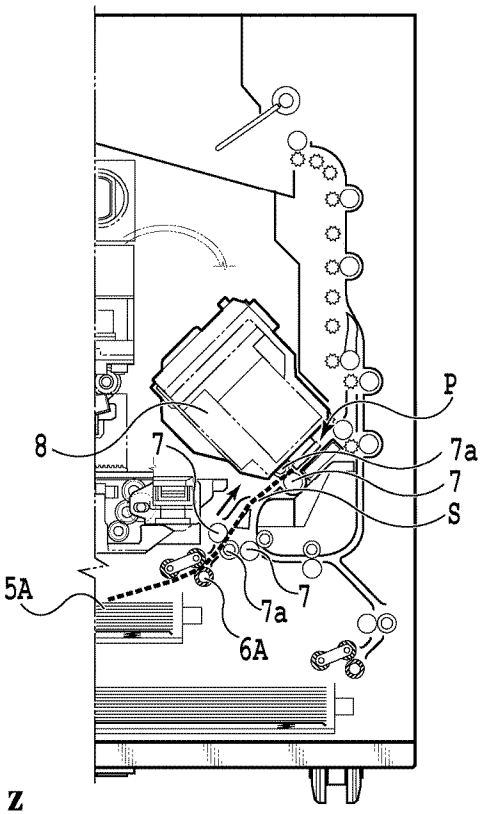

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 facing down.

Figure 5C:
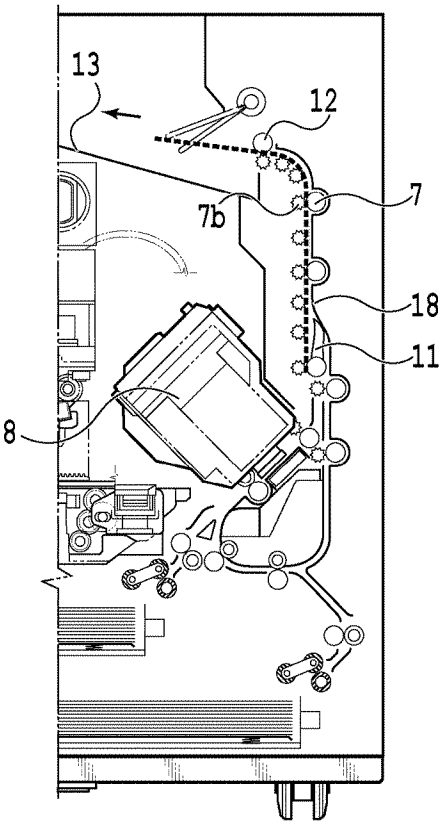
FIGS. 5A to 5C are conveying path diagrams of a print medium fed from a second cassette.
Figure 5B:
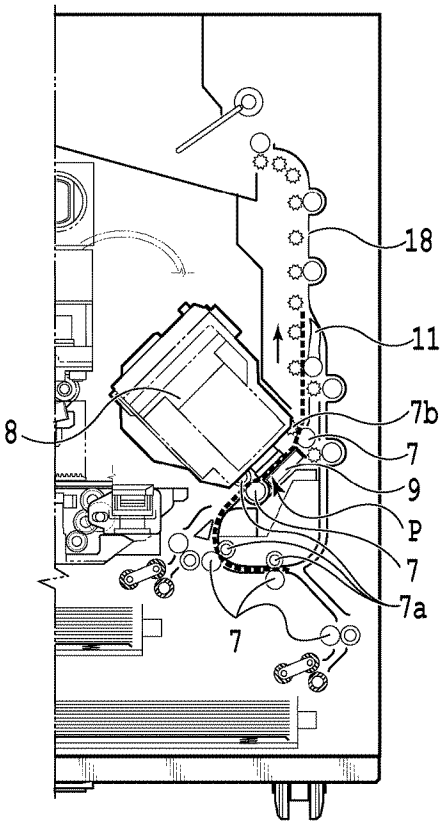
Figure 5A:
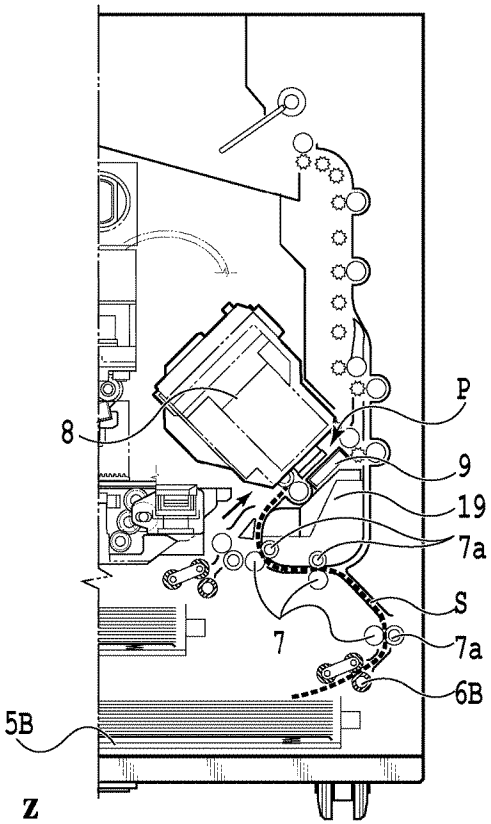

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, the print operation is first performed for the first side (front side), and is then performed for the second side (back side). A conveying procedure during the print operation for the first side is the same as that shown in FIGS. 4A to 4C and, therefore, a description will be omitted. A conveying procedure subsequent to FIG. 4C will be described below.

Figures 6A, 6B, 6C, 6D:
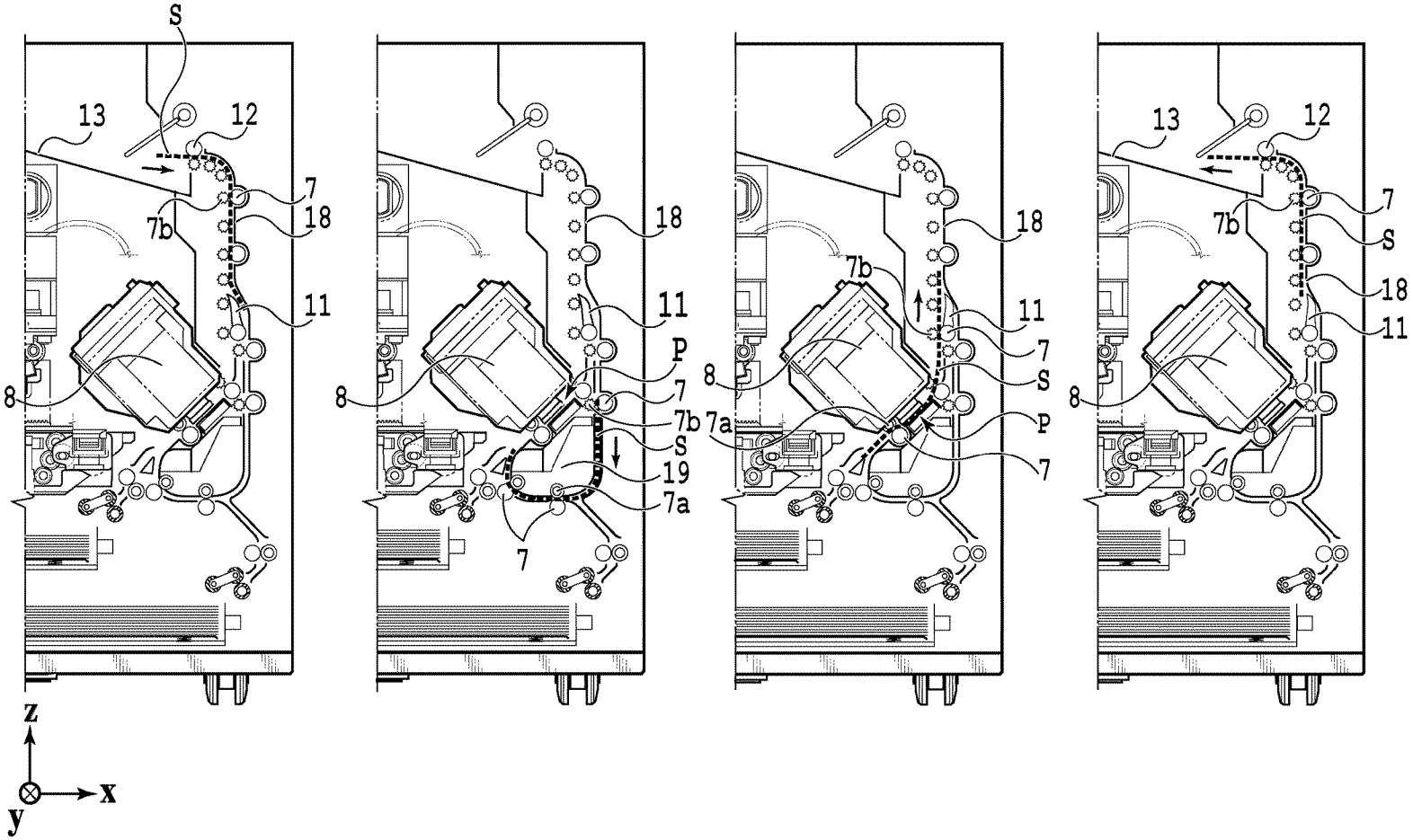
FIGS. 6A to 6D are conveying path diagrams in the case of performing print operation for the back side of a print medium.

After the print head 8 finishes the print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and is then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for the print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller and the print medium S is being discharged into the discharging tray 13.

Next, the maintenance operation for the print head 8 will be described. As described with reference to FIG. 1, the maintenance unit 16 of the present embodiment comprises the cap unit 10 and the wiping unit 17 and activates them at predetermined timings to perform the maintenance operation.

Figure 7:
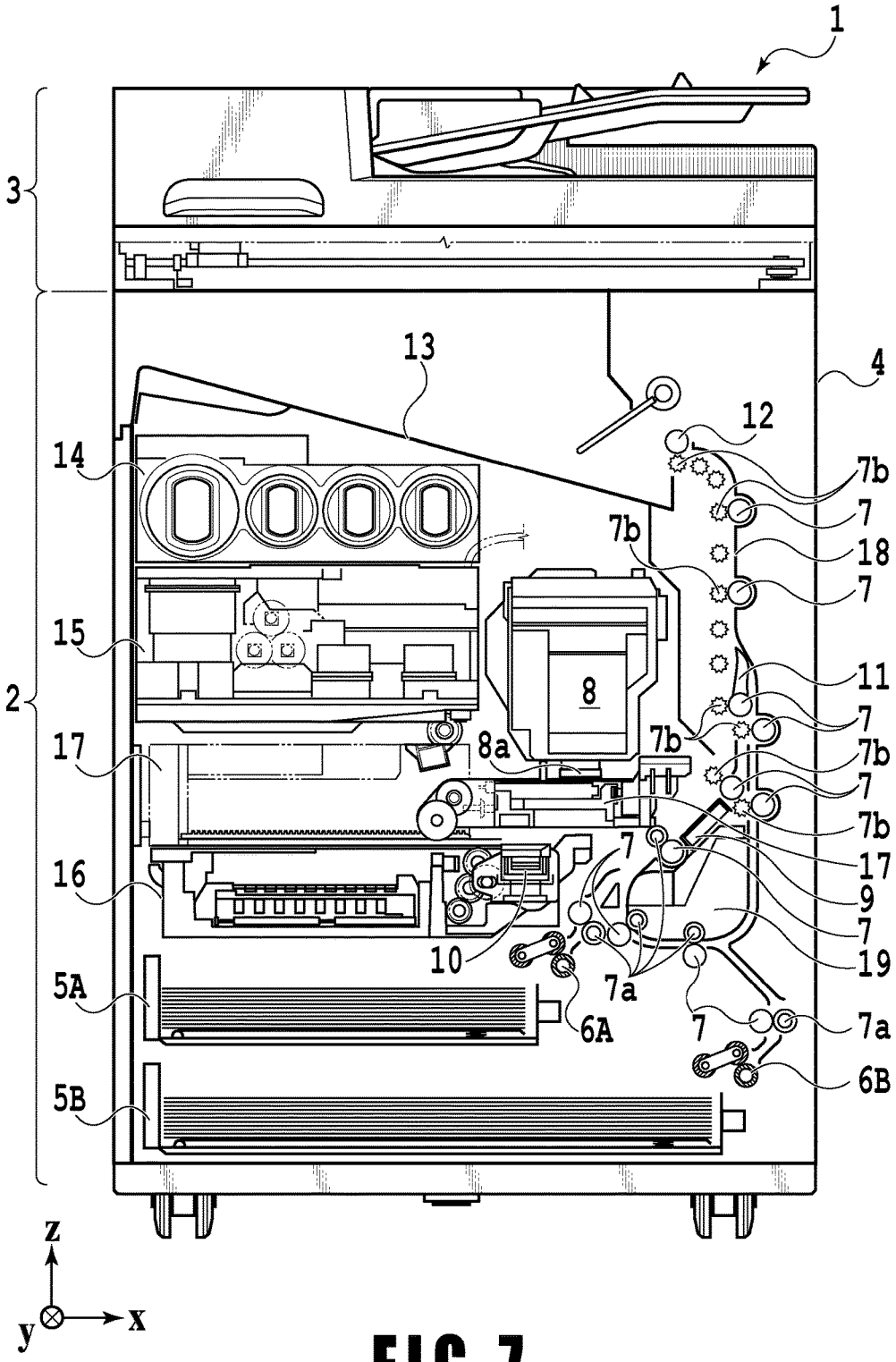
FIG. 7 is a diagram showing the printing apparatus in a maintenance state.

FIG. 7 is a diagram showing the printing apparatus 1 in a maintenance state. In the case of moving the print head 8 from the standby position, shown in FIG. 1, to a maintenance position, shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where the maintenance operation can be performed.

On the other hand, in the case of moving the print head 8 from the printing position, shown in FIG. 3, to the maintenance position, shown in FIG. 7, the print controller 202 moves the print head 8 vertically upward while turning it by 45°. The print controller 202 then moves the wiping unit 17 from the evacuation position to the right. Following that, the print controller 202 moves the print head 8 vertically downward to the maintenance position where the maintenance operation can be performed by the maintenance unit 16.

Figure 8A:
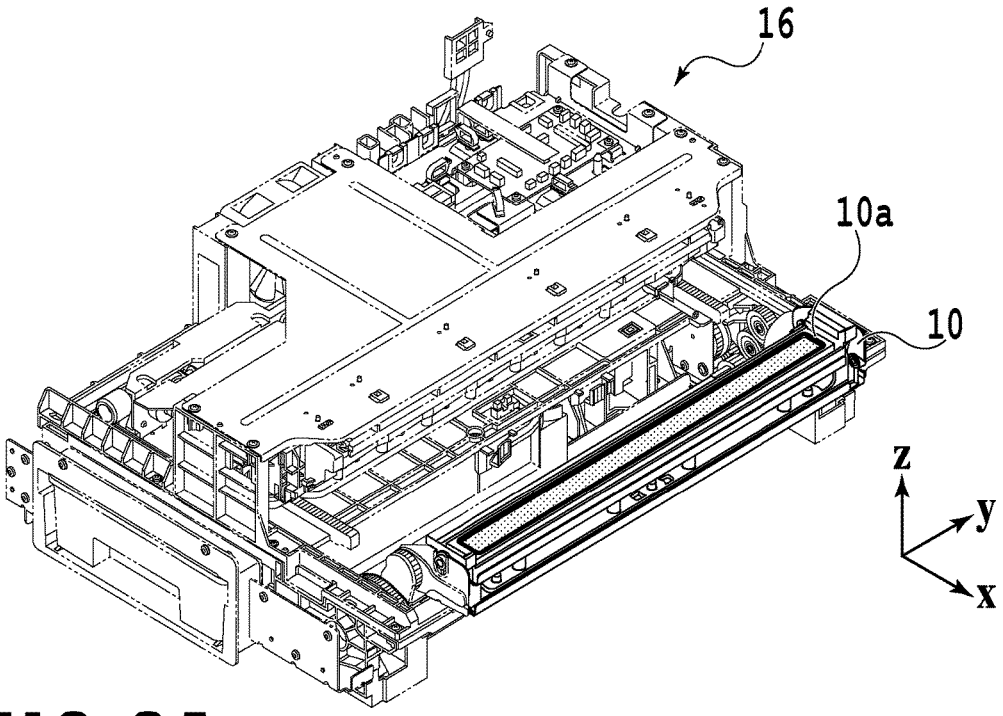
FIGS. 8A and 8B are perspective views showing the configuration of a maintenance unit.
Figure 8B:
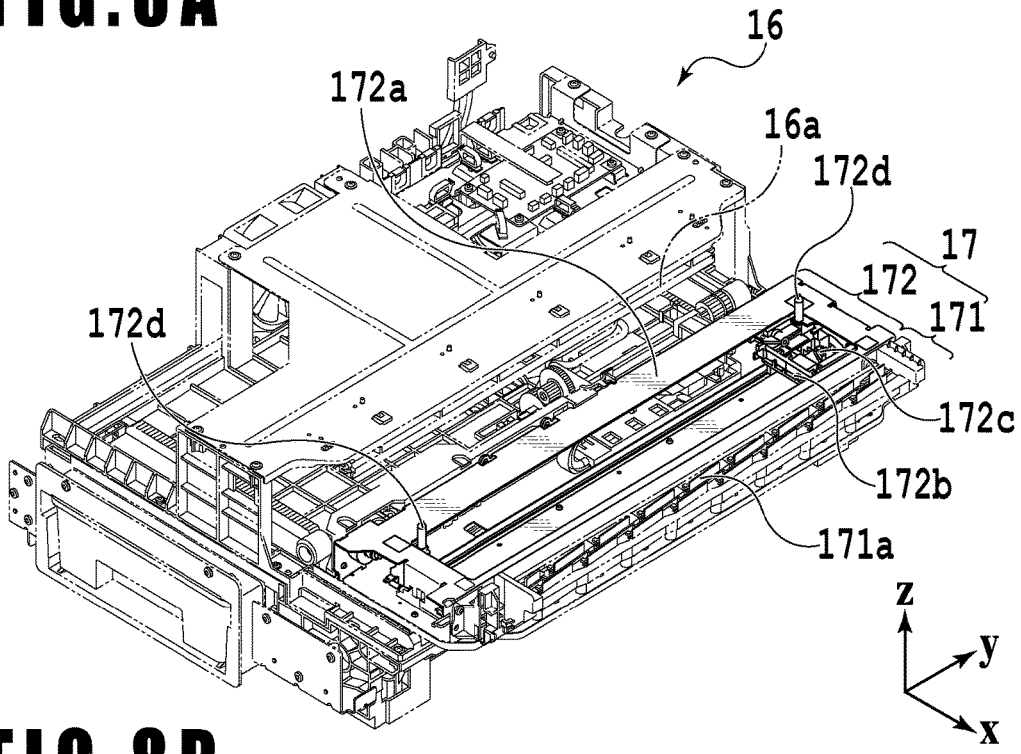

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing the wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process, in which the blade wiper unit 171 performs the wiping operation and the vacuum wiper unit 172 does not perform the wiping operation, and a second wiping process, in which both the wiper units sequentially perform the wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink, and the like, adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform the wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member and a suction operation of collected ink in the same manner as the first wiping process.

Figure 9:
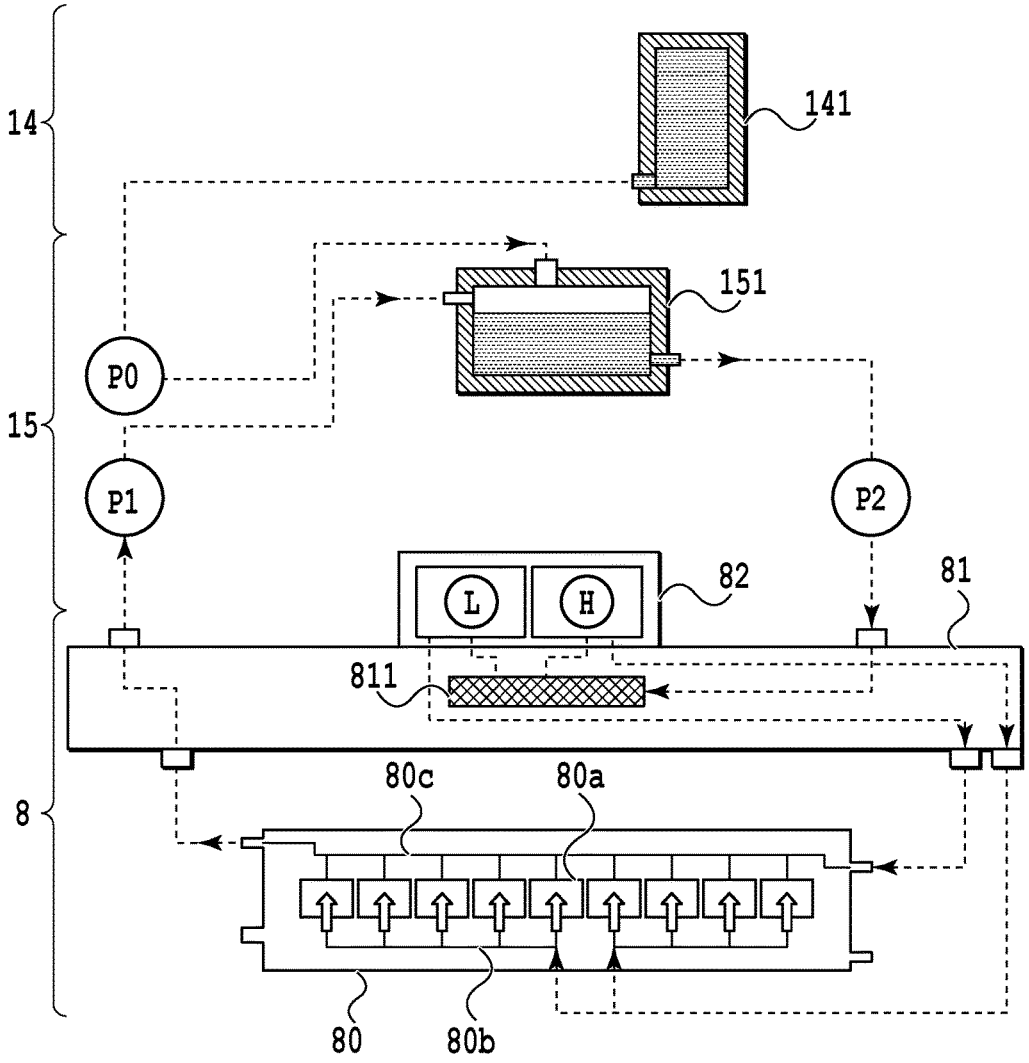
FIG. 9 is a diagram showing a circulation type ink supply system.

FIG. 9 is a diagram showing a circulation type ink supply system used in the inkjet printing apparatus 1 of the present embodiment. The circulation type ink supply system is formed by connecting the ink tank unit 14, the ink supply unit 15, and the print head 8. FIG. 9 shows a circulation system for one ink color, but such a circulation system is actually prepared for each of several ink colors.

The ink tank unit 14 is equipped with a main tank 141 that stores a relatively large amount of ink. The ink supply unit 15 includes a buffer tank 151 and three pumps P0, P1, and P2 connected to the buffer tank 151. Circulation pumps P1 and P2 cause ink to flow in the entire circulation path such that ink moves from the circulation pump P1 toward the circulation pump P2 through the buffer tank 151 in the supply system. A refilling pump P0 is activated when the amount of ink remaining in the buffer tank 151 becomes low to refill the buffer tank 151 with fresh ink from the main tank 141.

The print head 8 comprises an ink ejection unit 80, a circulation unit 81, and a negative pressure control unit 82. The ink ejection unit 80 has a mechanism to eject ink droplets based on ejection data. The present embodiment uses a system of providing each printing element with a heater, applying voltage to the heaters to cause film boiling in ink, and utilizing the growth energy of bubbles for ejecting the ink from the ejection openings. The negative pressure control unit 82 makes adjustments such that the ink flows in a right direction at a suitable pressure in the ink ejection unit 80. The ink circulation unit 81 controls ink supply and collection among the buffer tank 151, the negative pressure control unit 82, and the ink ejection unit 80.

Ink supplied from the buffer tank 151 to the circulation unit 81 is supplied to the negative pressure control unit 82 through a filter 811. The negative pressure control unit 82 comprises a negative pressure control unit H that causes ink to flow out at high fluid pressure and a negative pressure control unit L that causes ink to flow out at low fluid pressure. Ink flowing out from the negative pressure control unit H and ink flowing out from the negative pressure control unit L are supplied to the ink ejection unit 80 along different paths through the circulation unit 81.

In the ink ejection unit 80, a plurality of printing element substrates 80*a*, each comprising a plurality of nozzles arrayed in the y-direction, are arrayed in the y-direction to form an elongated nozzle array. The ink ejection unit 80 also includes a common supply flow path 80*b* for guiding ink supplied at high fluid pressure from the negative pressure control unit H and a common collection flow path 80*c* for guiding ink supplied at low fluid pressure from the negative pressure control unit L. Each of the printing element substrates 80*a* is equipped with an individual flow path connected to the common supply flow path 80*b* and an individual flow path connected to the common collection flow path 80*c*. Consequently, an ink flow is produced such that ink flows into the printing element substrates 80*a* through the common supply flow path 80*b* having high pressure and flows out through the common collection flow path 80*c* having low pressure. When the printing element substrates 80*a* perform ejection operation, circulating ink is partly consumed by the ejection and the rest of the ink is led to the circulation unit 81 through the common collection flow path 80*c* and returned to the buffer tank 151 through the circulation pump P1.

In the circulation type ink supply system described above, heat generated in ejection operation of the printing element substrates 80*a* is dissipated by circulating ink. It is therefore possible to prevent an ejection failure caused by heat accumulation even in the case of continuous ejection operation. Further, bubbles, thickened ink, foreign matter and the like that are produced in ejection operation are less prone to stay. Accordingly, all nozzles can be maintained in a good ejection state.

In particular, since bubbles produced in the ejection operation have the property of moving upward, there is a possibility that the bubbles stay in a particular printing element substrate 80*a* or a particular ejection opening if the print operation is performed with the ejection opening surface 8*a* (i.e., the ink ejection unit 80) inclined, like the present embodiment. The use of the circulation type ink supply system makes it possible to reliably collect produced bubbles through the common collection flow path 80*c*, thereby increasing the degree of freedom of the posture of the print head 8 in ejection operation. As a result, the printing position shown in FIG. 3 is possible and the apparatus can be downsized.

In contrast, in the maintenance position, it is preferable that the ejection opening surface 8*a* is horizontal to equalize the influence of gravity on the printing element substrates 80*a* and the ejection openings. For this purpose, the print head 8 should be moved between the standby position shown in FIG. 1, the printing position shown in FIG. 3, and the maintenance position shown in FIG. 7 as appropriate. This requires a simple configuration capable of moving the print head 8 in a short time.

FIGS. 10A to 10E are diagrams showing a mechanism to move the print head 8 between the standby position, the printing position, and the maintenance position. FIG. 10A corresponds to the standby position shown in FIG. 1. FIG. 10B is a first transition diagram from the standby position to the printing position. FIG. 10C is a second transition diagram from the standby position to the printing position. FIG. 10D corresponds to the printing position shown in FIG. 3. FIG. 10E corresponds to the maintenance position shown in FIG. 7.

A first pin 801, a second pin 802, and a third pin 803, constituting engagement portions to be engaged with other members, protrude from both the side surfaces of the print head 8 in the y-direction. The first pin 801 is provided in the upper left part of the print head 8 in the drawings and is engaged with a first body guide 501, and is movable along a first guide 501*a*. The upper part of the first guide 501*a* has a linear shape extending vertically. The lower part of the first guide 501*a* has a shape bent to the right in FIGS. 10A to 10E. The print head 8 is turned by moving the first pin 801 along this bent shape. The second pin 802 is provided in the lower part of the print head 8 and is engaged with a second body guide 502, and is movable along a second guide 502*a*. The second guide 502*a* is partly bent into an S-shape to the lower right in FIGS. 10A to 10E. The print head 8 is turned by moving the second pin 802 along this bent shape. The first body guide 501 and the second body guide 502 are fixed to the printing apparatus 1. The third pin 803 is provided in the upper part of the print head 8 and is engaged with a slide member 503, which is slid by the drive gear 504 with respect to the body of the apparatus, and is movable along a third guide 503*a*. The third guide 503*a* is partly bent into an inverted V-shape. The print head 8 is turned by moving the third pin 803 to the left in FIGS. 10A to 10E along the third guide 503*a*.

The slide member 503 is an L-shaped member. A gear rail 503*b* formed on the left side surface of the slide member 503 meshes with a drive gear 504 fixed to the body of the apparatus and thus can be vertically slid along with the turn of the drive gear 504. At this time, since the third pin 803 of the print head 8 is supported by the third guide 503*a*, the print head 8 is moved vertically together with the slide member 503. Along with this vertical movement, the first pin 801 and the second pin 802 are moved along the first guide 501*a* and the second guide 502*a*, respectively. The direction and quantity of the turn of the drive gear 504 are controlled by the head carriage control unit 208 under instructions from the print controller 202.

In the standby position shown in FIG. 10A, the ejection opening surface 8*a* is capped with the cap unit 10. The drive gear 504 is located in the middle of the gear rail 503*b*. Since the first pin 801 is located in the linear part of the first guide 501*a* and the second pin 802 is located in the linear part of the second guide 502*a*, the ejection opening surface 8*a* of the print head 8 is horizontal.

In the case of moving the print head 8 from the standby position shown in FIG. 10A to the printing position shown in FIG. 10D, the print controller 202 turns the drive gear 504 clockwise in the drawings. FIG. 10B is the first transition diagram showing the slide member 503 being slid vertically downward by the turn of the drive gear 504. The slide of the slide member 503 moves the first pin 801 down to the middle of the linear part of the first guide 501*a* and locates the second pin 802 in the middle of the S-shaped part of the second guide 502*a*. As a result, the print head starts rotational movement along the bent shape of the second guide 502*a* in addition to vertical downward movement.

FIG. 10C is the second transition diagram showing the slide member 503 being further slid vertically downward from the position shown in FIG. 10B. The first pin 801 is moved further down along the linear part of the first guide 501*a* and the second pin 802 is located in the middle of the S-shaped part of the second guide 502*a*. The print head 8 has been turned about 45°, the same angle as that in the printing position, by the movement along the bent shape of the second guide 502*a*.

If the slide member 503 is further slid vertically downward, the print head 8 is moved linearly from the second transition position shown in FIG. 10C to the lower right to reach the printing position shown in FIG. 10D. The lower part of the first guide 501*a* is substantially parallel to the lower part of the second guide 502*a* so as to move the print head 8 linearly to the lower right. The print head is aligned with the platen 9 by the linear movement from the second transition position to the printing position. The movement described above moves the drive gear 504 to the top of the gear rail 503*b*. In the movement described above, the first pin 801 and second pin 802 are moved to the right while coming down along the bent first guide 501*a* and second guide 502*a*, respectively. Accordingly, a relative distance of a horizontal component between the first pin 801 and the second pin 802 in the case where the print head 8 is located in the printing position is greater than that in the case where the print head 8 is located in the standby position. In contrast, a relative distance of a vertical component between the first pin 801 and the second pin 802 in the case where the print head 8 is located in the printing position is less than that in the case where the print head 8 is located in the standby position. As a consequence, the entire print head 8 is turned counterclockwise about 45° and the ejection opening surface 8*a* of the print head 8 faces the platen 9. This turn moves the third pin 803 to the left in the drawings along the third guide 503*a*. The third pin 803 is brought into contact with the third guide 503*a*, thereby fixing the position of the print head which has been turned about 45°.

In the case of moving the print head 8 from the printing position shown in FIG. 10D to the maintenance position shown in FIG. 10E, the print controller 202 turns the drive gear 504 counterclockwise. In the maintenance position, the ejection opening surface 8*a* is wiped by the blade wiper unit 171. The slide member 503 is slid vertically upward by turning the drive gear 504 by way of the states shown in the second transition diagram and first transition diagram such that the drive gear 504 is located at the bottom of the gear rail 503*b*. This returns the first pin 801 to the linear part of the first guide 501*a* and returns the second pin 802 to the linear part of the second guide 502*a*. The print head 8 passes through the standby position shown in FIG. 10A and reaches almost the top of the guides. The third pin 803 returns to the right end of the third guide 503*a*. That is, the print head 8 is moved vertically upward while turning clockwise and is stopped above the standby position shown in FIG. 1 in the orientation in which the ejection opening surface 8*a* is horizontal. It should be noted that FIGS. 10A and 10E show the cap unit 10 at the same height to compare the vertical positions of the print head 8 in the maintenance position and the standby position, but the actual cap unit 10 is moved vertically downward along with the vertical upward movement of the print head 8 so as to be separated from the ejection opening surface 8*a* when moving the print head 8 from the standby position to the maintenance position.

As described above, according to the present embodiment, the position and orientation of the print head 8 are changed by moving the first pin 801, second pin 802, and third pin 803 of the print head 8 along the first guide 501*a*, second guide 502*a*, and third guide 503*a*, respectively. The changes in position and orientation of the print head 8, that is, the linear movement and rotational movement of the print head 8, are made simultaneously by turning the single drive gear 504. Consequently, the print head 8 can be moved in a short time by a simpler configuration compared with a configuration in which a mechanism to perform linear movement and a mechanism to perform rotational movement are separately provided.

Figure 11A:
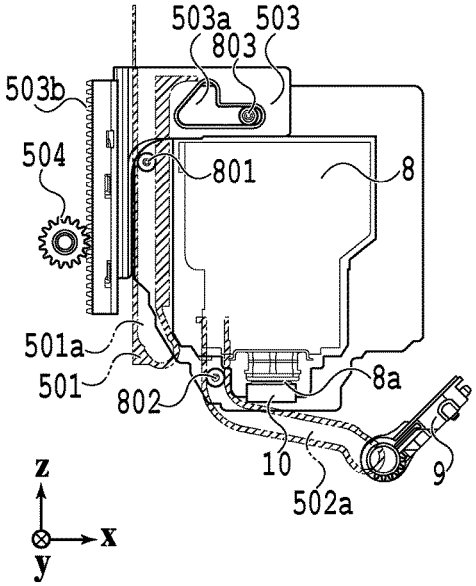
FIGS. 11A to 11D are diagrams showing a mechanism to move the print head.
Figure 11B:
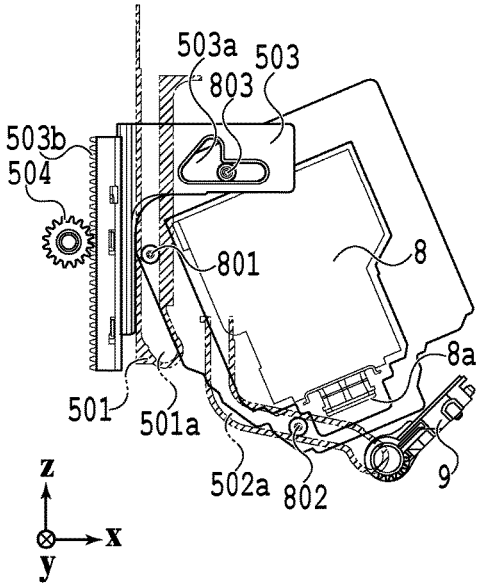
Figure 11C:
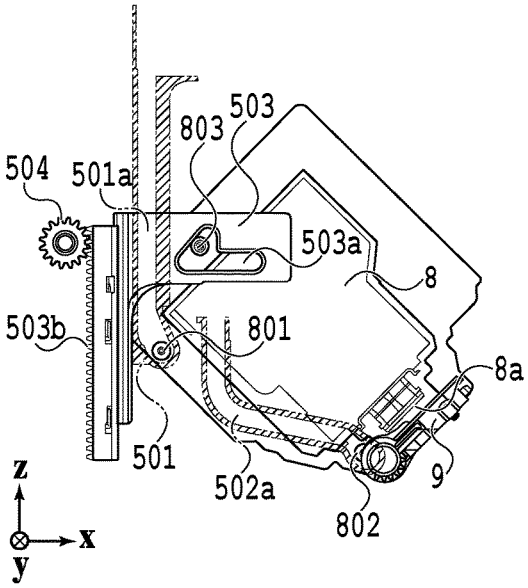
Figure 11D:
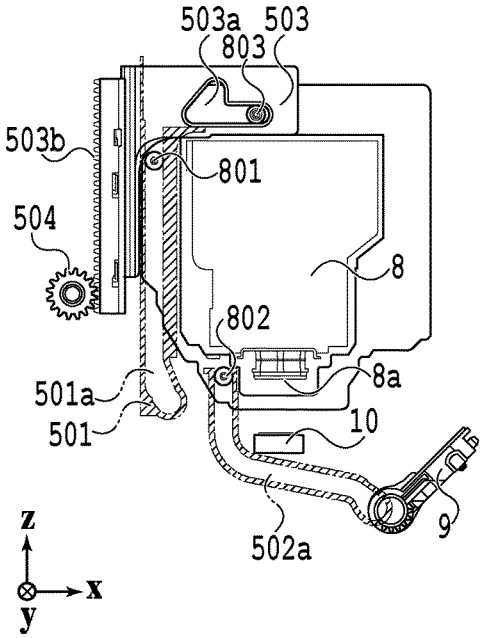

FIGS. 11A to 11D are diagrams showing a modification of the mechanism to move the print head 8 shown in FIGS. 10A to 10E. The modification is different mainly in the shapes of the second guide 502*a* and third guide 503*a* from FIGS. 10A to 10E. Further, the second pin 802 is provided in a different position to correspond to the shape of the second guide 502*a*. FIG. 11A corresponds to the standby position. FIG. 11B is a transition diagram showing the movement from the standby position to the printing position. FIG. 11C corresponds to the printing position. FIG. 11D corresponds to the maintenance position.

In the modification, the second guide 502*a* has a gently bent shape and its lower part has a linear shape extending substantially in parallel to the lower part of the first guide 501*a*. Since the position of the second guide 502*a* is lower than that shown in FIGS. 10A to 10E, the position of the second pin 802 is also lower than that shown in FIGS. 10A to 10E.

The third guide 503*a* has such a shape that the third pin 803 can be moved linearly as compared with FIGS. 10A to 10E. In the modification shown in FIGS. 11A to 11D, the vertical movement of the second pin 802 and the vertical movement of the third pin 803 are less than those in the case of FIGS. 10A to 10E. Accordingly, the print head 8 can be moved more smoothly from the standby position to the printing position.

In the embodiment described above, the print head 8 is located such that the ejection opening surface 8*a* is inclined 45° with respect to the horizontal plane in the printing position and is horizontal in the maintenance position. However, the present invention is not limited to this angle. The advantageous result of the present invention can be produced, that is, the print head 8 can be moved by a simple configuration, as long as the ejection opening surface 8*a* in the printing position is closer to a vertical posture than the ejection opening surface 8*a* in the maintenance position.

In the above description, the standby position in which the ejection opening surface 8*a* is horizontal is provided in the movement between the printing position and the maintenance position. However, the present invention is not limited to this configuration. In the standby position, the ejection opening surface 8*a* may be inclined at an angle greater than 0° and less than 90° with respect to the horizontal plane. The standby position may be the same as either the printing position or the maintenance position.

In the embodiment described above, the print head uses a system of causing film boiling in ink and utilizing the growth energy of bubbles for ejecting ink from ejection openings. However, the present invention is not limited to this print head. Further, the circulation type ink supply system is not essential to the present invention.

However, it should be noted that in the print head adopting the system of utilizing the growth energy of bubbles for ejecting ink, the removal of bubbles by the circulation type ink supply system is effective in stable ejection. Further, the circulation type ink supply system increases the degree of freedom of the posture of the print head in printing. That is, the combination of the print head adopting the system stated above and the circulation type ink supply system realizes the print operation in the posture shown in FIG. 3 and downsizing of the printing apparatus, thereby increasing the effectiveness of the function of moving the print head using a simple configuration like the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-028022 filed Feb. 17, 2017, which is hereby incorporated by reference wherein in its entirety.

What is claimed is:

1. An inkjet printing apparatus comprising:

a print head configured to perform a print operation, the print head having an ejection opening surface on which a plurality of ejection openings for ejecting ink are arrayed along an array direction; and a moving unit configured to move the print head between a printing position, in which the print operation is performed, and a standby position, in which the print operation is not performed, wherein the moving unit moves the print head between the printing position and the standby position by simultaneously performing rotational movement, in which the print head is rotated around a rotation axis that is parallel to the array direction, and linear movement, in which the print head is moved linearly in the gravitational direction, of the print head.

2. The inkjet printing apparatus according to claim 1, wherein the moving unit uses a single driving source to perform the rotational movement and the linear movement of the print head.

3. The inkjet printing apparatus according to claim 1, further comprising an engagement portion provided on the print head, wherein the moving unit is a slide member engaged with the engagement portion, and slides in a predetermined direction with respect to a body of the inkjet printing apparatus.

4. The inkjet printing apparatus according to claim 3, further comprising a guide member fixed to the body of the inkjet printing apparatus, engaged with the engagement portion, and configured to guide the print head, wherein the engagement portion of the print head is moved along the guide member by sliding the slide member in the predetermined direction.

5. The inkjet printing apparatus according to claim 4, wherein the engagement portion includes a first engagement portion, a second engagement portion, and a third engagement portion, wherein the guide member includes a first body guide engaged with the first engagement portion, and a second body guide engaged with the second engagement portion, and wherein the slide member is engaged with the third engagement portion.

6. The inkjet printing apparatus according to claim 5, wherein the second body guide rotates the print head while guiding the second engagement portion.

7. The inkjet printing apparatus according to claim 1, wherein, in a case in which the print head is in the standby position, the ejection opening surface is closer to a horizontal posture than in a case in which the print head is in the printing position.

8. The inkjet printing apparatus according to claim 7, wherein the ejection opening surface is kept at an angle greater than 0 degree and less than 90 degrees with respect to a horizontal direction in a case where the print head is in the printing position, and wherein the ejection opening surface is kept substantially horizontal in a case in which the print head is in the standby position.

9. The inkjet printing apparatus according to claim 8, wherein the ejection opening surface is kept at about 45 degrees with respect to the horizontal direction in a case in which the print head is in the printing position.

10. The inkjet printing apparatus according to claim 1, further comprising a cap configured to cap the ejection opening surface, wherein the cap caps the ejection opening surface in a case in which the print head is in the standby position.

11. The inkjet printing apparatus according to claim 1, further comprising a maintenance unit configured to perform a maintenance operation for the print head, wherein the moving unit is further configured to move the print head to a maintenance position, in which the maintenance unit performs the maintenance operation.

12. The inkjet printing apparatus according to claim 11, wherein the maintenance unit includes a wiper configured to perform a wiping operation for wiping the ejection opening surface, and wherein the wiper performs the wiping operation in a case in which the print head is in the maintenance position.

13. The inkjet printing apparatus according to claim 11, wherein, in a case in which the print head is in the standby position, the position of the ejection opening surface is lower in the gravitational direction than that in a case in which the print head is in the maintenance position.

14. The inkjet printing apparatus according to claim 1, further comprising a conveying unit configured to convey a print medium, wherein the print head is a full line type print head, of which the ejection openings are arrayed in a width direction of a print medium conveyed by the conveying unit.

15. The inkjet printing apparatus according to claim 1, further comprising:

an ink tank unit configured to store ink to be supplied to the print head; and an ink supply unit connecting the ink tank unit to the print head, and configured to supply the ink from the ink tank unit to the print head.

16. The inkjet printing apparatus according to claim 15, further comprising an ink collecting unit connecting the print head to the ink tank, and configured to collect ink from the print head to the ink tank unit.

17. The inkjet printing apparatus according to claim 16, further comprising a circulation unit configured to circulate the ink between the ink tank unit and the print head while adjusting a fluid pressure of the ink.

18. The inkjet printing apparatus according to claim 1, wherein the print head causes film boiling in ink to eject the ink from the plurality of ejection openings.

19. An inkjet printing apparatus comprising:

a print head configured to perform a print operation, the print head having an ejection opening surface on which a plurality of ejection openings for ejecting ink are arrayed along an array direction; and a moving unit configured to move the print head between a printing position, in which the print operation is performed, and a standby position, in which the print operation is not performed, wherein the moving unit moves the print head between the printing position and the standby position by performing rotational movement, in which the print head is rotated around a rotation axis that is parallel to the array direction, and linear movement, in which the print head is moved linearly in the gravitational direction, of the print head by using a single driving source.

20. The inkjet printing apparatus according to claim 19, further comprising a slide member engaged with the print head and configured to slide in a predetermined direction, wherein the driving source performs the rotational movement and the linear movement of the print head by sliding the slide member in the predetermined direction.

* * * * *